United States Patent [19]

De Lorenzi et al.

[11] Patent Number: 4,499,973

[45] Date of Patent: Feb. 19, 1985

[54] TRANSPORTATION SYSTEM

[75] Inventors: John J. De Lorenzi, Washington; Elmer H. Sumka, Edison, both of N.J.

[73] Assignee: Westinghouse Electric Corp., Pittsburgh, Pa.

[21] Appl. No.: 478,440

[22] Filed: Mar. 24, 1983

[51] Int. Cl.[3] ..... B66B 1/18

[52] U.S. Cl. ..... 187/29; 318/369

[58] Field of Search ..... 187/29, 29 R

[56] References Cited

U.S. PATENT DOCUMENTS

| | | | |
|---|---|---|---|
| 3,467,223 | 9/1969 | Suozzo et al. | 187/29 R |
| 4,276,500 | 6/1981 | Sumka et al. | 318/367 X |
| 4,431,085 | 2/1984 | MacDonald | 187/29 R |

*Primary Examiner*—J. V. Truhe

*Assistant Examiner*—Paul Shik Luen Ip

*Attorney, Agent, or Firm*—D. R. Lackey

[57] ABSTRACT

A transportation system including a group of elevator cars under the control of a group supervisory dispatcher function, and people mover apparatus arranged to serve the group of elevator cars. The group supervisory dispatcher function includes call assigning control which has different selectable strategies for serving different types of elevator service requirements, including at least one travel direction oriented strategy for expediting elevator service in a predetermined travel direction. The people mover apparatus provides signals responsive to loading and travel direction for use by the dispatcher function, enabling proper strategies to be selected without waiting for actual elevator traffic to trigger such selections.

1 Claim, 8 Drawing Figures

TRANSPORTATION SYSTEM

BACKGROUND OF THE INVENTION

1. Field of the Invention

The invention relates in general to transportation systems, and more specifically to elevator systems served by people mover apparatus.

2. Description of the Prior Art

An elevator system for a building having a plurality of elevator cars conventionally includes group supervisory control for directing the elevator cars to serve the traffic in an orderly, efficient manner. Normally, the group supervisory control attempts to provide a balanced type of service for the building, dividing its efforts substantially equally between serving the main floor or lobby, serving up hall calls, and serving down hall calls. The group supervisory control also will include other operating strategies triggered by actual system conditions, which temporarily modify the balanced strategy. For example, an elevator car leaving the main floor with a passenger load which exceeds a predetermined value, may trigger an up peak mode or strategy. Such a traffic peak may occur in the morning, when the building is initially populated, and also at the termination of the lunch hour. The up peak mode, for example, may attempt to maintain a predetermined quota of elevator cars at the main floor, and place restrictions upon when an elevator car can become available for serving other types of system demands.

A down traveling car which starts to bypass down hall calls because of the passenger load reaching a predetermined value may trigger a down peak mode or strategy. Such a down traffic peak may occur at the start of the lunch hour, and also when the building is depopulated at the end of the work day. The down peak mode, for example, may eliminate any main floor quota and immediately assign each elevator car as it becomes available to a predetermined down call. When the highest down call has been assigned, for example, subsequent available cars may be assigned to the middle down call of the remaining unassigned down calls.

SUMMARY OF THE INVENTION

When an elevator system is served by people mover means, such as by movable walks and/or escalators, the present invention provides certain signals from the people mover means related to the traffic intensity and travel direction of the people mover means. These signals are utilized by the group supervisory control function of the elevator system to anticipate certain elevator traffic peaks, enabling the group supervisory control to immediately select an appropriate operating mode for efficiently handling the traffic peak. In a conventional elevator system, an actual traffic peak must occur before an appropriate operating strategy is triggered, and thus, since the peak is already occurring, there is a delay in getting the elevator system into the correct mode to efficiently serve the peak.

More specifically, if the people mover means detects traffic exceeding a predetermined threshold level proceeding towards the elevator system, it issues a signal and the group supervisory control of the elevator system can immediately select an up peak operating mode, in which it will start to gather a predetermined quota of cars at the incoming floor to serve the peak. In the prior art, there would probably be only one elevator car at the incoming floor. This car would have to be loaded to a predetermined value before the up peak mode would be triggered, to expedite additional cars to the main floor to serve the remaining passengers.

In addition to anticipating an up peak mode, when passengers are being carried by the people mover means towards the elevator system, the people mover means may actually detect a down peak condition before the elevator system does, and place the elevator system in a down peak mode earlier than would otherwise be the case. The people mover means is able to respond to the elevator system as a whole, while the system down peak is per car related. For example, a number of cars may be delivering passengers to the main floor, with the load in each car being just below the load level which triggers hall call bypassing. Thus, the system down peak will not be triggered. The collective volume of passengers from the elevator system on the people mover means, however, proceeding in a direction away from the elevator cars, may be used as another down peak mode trigger.

BRIEF DESCRIPTION OF THE DRAWINGS

The invention may be better understood, and further advantages and uses thereof more readily apparent, when considered in view of the following detailed description of exemplary embodiments, taken with the accompanying drawings in which.

DESCRIPTION OF PREFERRED EMBODIMENTS

The present invention relates to a transportation system which includes an elevator system served by people mover means. For purposes of example, it will be assumed that the people mover means includes an escalator, or escalators, but the invention covers any type of people mover means adapted to serve an elevator system. In order to limit the length and complexity of the present application, it will be assumed that the elevator system is the system collectively shown in U.S. Pat. Nos. 3,750,850; 3,804,209; and 3,851,734, and that the escalator control is the control shown in U.S. Pat. No. 4,276,500. These patents, all of which are assigned to the same assignee as the present application, are hereby incorporated into the present application by reference.

Figure 1:
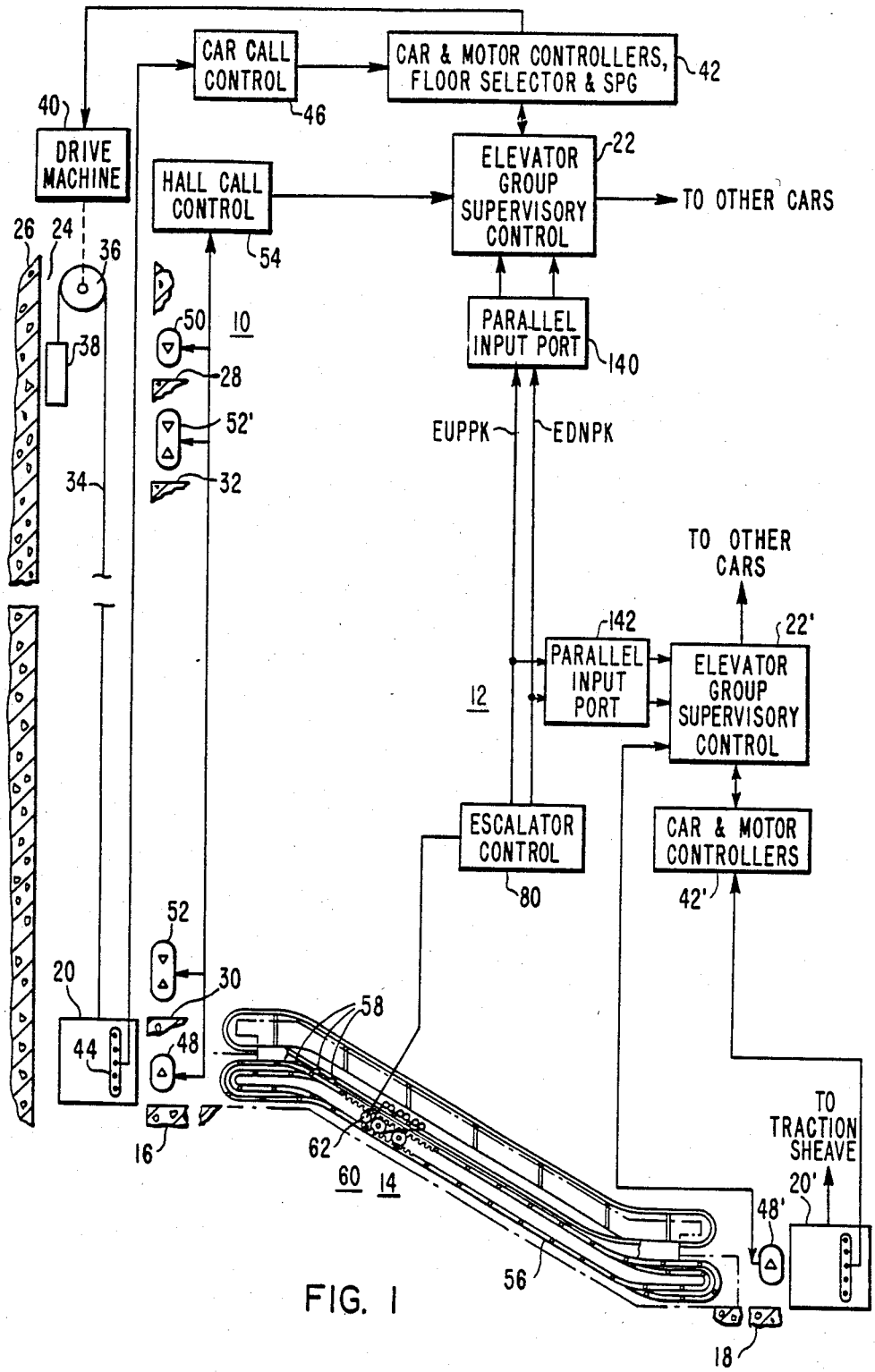
FIG. 1 is a diagrammatic representation of a transportation system constructed according to the teachings of the invention.

Referring now to the drawings, and to FIG. 1 in particular, there is shown a transportation system 10 constructed according to the teachings of the invention. While most transportation systems which will utilize the teaching of the invention will include a single group or bank of elevator cars, first and second groups 12 and 14 of elevator cars are shown in FIG. 1 in order to illustrate that one or more escalators, such as escalator 14, may be arranged to bring prospective passengers to a group of elevator cars by either up or down travel. For example, elevator system 10 may have a main or lobby floor 16 located above a main passenger entry floor 18, with escalator 14 traveling upwardly to delivery prospective passengers to the elevator system, and downwardly to take departing passengers away from the elevator system. In like manner, floor 16 may be a main passenger entry floor and escalator 14 may be arranged to travel downwardly to deliver prospective passengers to the main elevator entrance floor 18, located below the level of floor 16. Also, while escalator 14 is shown arranged to serve a bottom terminal floor, the invention will improve an elevator system regardless of the floor which the people mover apparatus serves. For example, the people mover apparatus may serve an intermediate floor, or even the upper terminal floor of certain types of buildings.

Elevator system 10 includes a plurality of elevator cars, such as car 20, with the movement of the cars being controlled by group supervisory control 22, such as shown in incorporated U.S. Pat. Nos. 3,804,209 and 3,851,734. Since all of the elevator cars of the group of cars are similar and have similar control, only car 20 is illustrated in FIG. 1. Car 20 is mounted in the hoistway 24 of a building 26 having a plurality of floors or landings, only a few of which are shown in the drawing, such as the upper terminal floor 28, and intermediate floors 30 and 32, in addition to the lower terminal floor 16. Car 12 may be part of a traction elevator system in which it is supported by a plurality of wire ropes, shown generally at 34, which are reeved over a traction sheave 36 and connected to a counterweight 38. Sheave 36 is driven by a traction drive machine 40, which in turn is responsive to a motor controller shown generally at 42.

Car calls entered by passengers in the car 20, such as via a pushbutton array 44, are directed to car call control 46, such as shown in the incorporated U.S. Pat. No. 3,804,209, and the processed car calls are communicated to the associated car controller, shown generally at 42. The car controller includes speed pattern and floor selector functions, such as shown in the incorporated U.S. Pat. No. 3,750,850. Hall calls by prospective passengers may be entered via pushbuttons located in the hallways adjacent to the elevator car entrances, such as up and down pushbuttons 48 and 50, respectively, at the lower and upper terminal floors, and up and down pushbutton combinations 52 and 52' located at the intermediate floors 30 and 32, respectively. The hall calls are processed in hall call control 54, such as shown in incorporated U.S. Pat. No. 3,804,209, and they are then directed to the group supervisory control 22. Supervisory control 22 makes assignments to the elevator cars of the controlled group. Incorporated U.S. Pat. No. 3,851,734 describes a group operating strategy which may be used, and it includes a special traffic direction oriented operating strategy when it detects direction oriented traffic peaks. For example, it may detect an up traffic peak by load exceeding a predetermined value in the car which is to be the next car to leave the main floor or lobby. An elevator car provides a signal WT50 when its passenger load exceeds 50% of capacity, and this signal may be used to trigger the up peak mode, when the associated elevator car is being loaded at the main or lobby floor. The up traffic peak mode is initiated by setting a software timer UPTIM, with the up peak modifications being incorporated into the system as long as this timer is active. The modifications are biased to return elevator cars as quickly as possible to the main floor. The operating strategy of U.S. Pat. No. 3,851,734 also includes a special traffic direction operating strategy which is triggered when a down traffic peak is detected. Such a traffic peak may be detected when a down traveling car starts to bypass down hall calls due to the passenger load in the car reaching a predetermined level. A true signal BYPS is provided by an elevator car when it starts to bypass down hall calls. The special down peak mode is initiated by setting a software timer DPK, and the normal operating strategy is modified while this timer is active, with the modifications being biased to cause each elevator car, as it becomes available, to serve down hall calls.

Elevator system 12 may be similar to elevator system 10, with like functions being referred to with like reference numerals, except for the addition of a prime mark.

Escalator 14 includes a conveyor or endless belt 56 having a plurality of steps 58 connected thereto, with the steps being driven in an endless loop by at least one drive unit 60. Drive unit 60, as shown in greater detail in FIG. 2, includes an electrical drive motor 62 which drives the conveyor 56 via a gear reducer 64. The gear reducer 64 includes input and output shafts 66 and 68, respectively, with the drive motor 62 being coupled to the input shaft 66 via any suitable means, such as via the motor output shaft 70, pulleys 72 and 74, and a timing belt 76. A brake 78 may also be mounted on the input shaft of the gear reducer 62.

Figure 2:
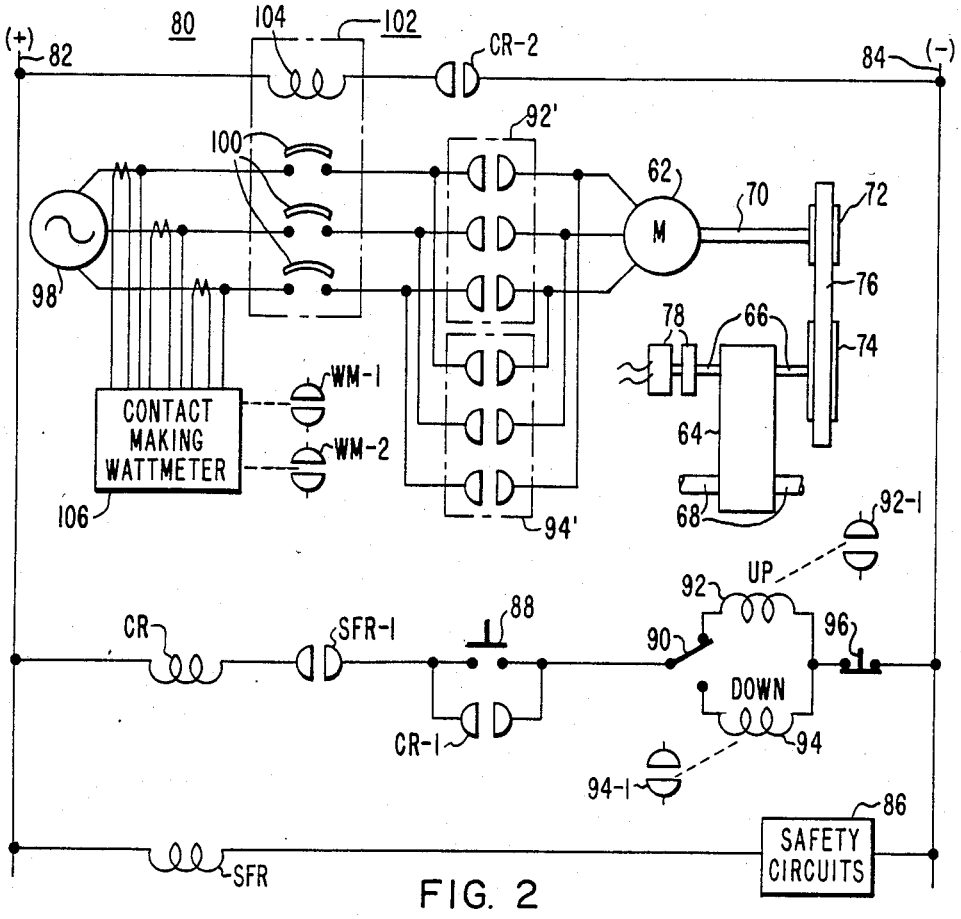
FIG. 2 is a schematic diagram of escalator control which may be used for the escalator control shown in block form in FIG. 1.

FIG. 2 is a schematic diagram of escalator control 80 which may be used for operating the escalator 14 shown in FIG. 1. A safety relay SFR is connected between electrical conductors 82 and 84 via a string of safety contacts, shown generally as safety circuits 86. Electrical conductors 82 and 84 are connected to a source of unidirectional electrical potential. The safety circuits may include contacts from broken belt switches, switches responsive to broken step links, skirt safety switches, step up thrust switches, broken drive chain switches, under/overspeed switch, maintenance switches, and the like. If the safety circuits 86 indicate there is no malfunction in the escalator system, relay SFR is energized and it closes a contact SFR-1 in the circuit of a control relay CR. A start pushbutton 88 completes a series circuit between conductors 82 and 84, which also includes the electromagnetic coil of the control relay CR, a direction control arrangement including a selector switch 90 arranged to select either the up or down travel direction relays 92 and 94, respectively, a stop pushbutton 96, and the n.o. contact SFR-1 of safety relay SFR. A seal-in contact CR-1 of relay CR is serially connected across the start pushbutton 96.

Drive motor 62 may be a three-phase induction motor which is connected to a source 98 of three-phase electrical potential via the contacts 100 of an electrical contactor 102, and via either the up or down direction selection contacts 92' and 94' of up and down direction relays 92 and 94, respectively. Contactor 102 includes an operating coil 104 connected between conductors 82 and 84 via a n.o. contact CR-2 of the control relay CR.

According to the teachings of the invention, means is provided to obtain an indication of passenger load on the escalator. Any suitable means may be provided which accurately reflects the passenger load. For purposes of example, a contact making watt meter 106 is provided which is connected to indicate the instantaneous electrical power usage by the escalator 14 at any instance.

Figure 5:
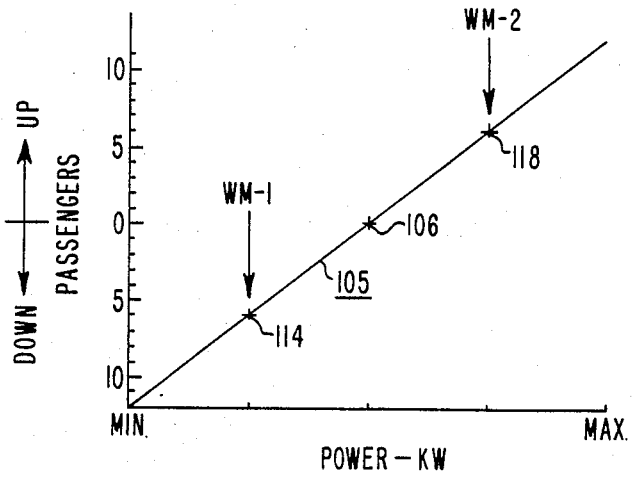
FIG. 5 is a graph which illustrates typical drive power versus passenger loading and direction for an escalator.

FIG. 5 is a graph which plots travel direction and passenger load against electrical power usage of a drive unit. As illustrated in FIG. 5, the electrical power usage by an unloaded escalator is about the same for either travel direction, for example around 2 KW for a modulator drive unit such as disclosed in U.S. Pat. No. 3,677,388. When an up traveling escalator is loaded, the electrical power usage increases with increasing passenger load. When a down traveling escalator is loaded, the electrical power usage decreases with increasing passenger load, and may become regenerative. This defines a curve 105 which starts at a minimum for a loaded escalator traveling in the down direction, and it increases substantially linearly as passenger load is decreased. Curve 105 continues to increase substantially linearly as the downwardly traveling escalator reaches no-load, the direction is changed to the up direction, and the upwardly traveling escalator is gradually loaded with passengers. Returning to FIG. 2, watt meter contacts WM-1 and WM-2, for example, may be arranged to both be open when the escalator is unloaded, or when the passenger load is light, in either travel direction. If the escalator, while traveling in the downward direction, exceeds a predetermined passenger load, the electrical power consumed will drop below a predetermined KW consumption by the drive motor 62. Contact WM-1 is arranged to close when the KW consumption drops below this selected predetermined level, and of course it will open again when the KW consumption rises above this preselected level. A slight hysteresis prevents "teasing". On the other hand, if the escalator is traveling in the upward direction and it exceeds a predetermined passenger load, the electrical power consumed by drive motor 62 will increase beyond a predetermined KW consumption. Contact WM-2 is arranged to close when this preselected KW consumption is exceeded, and of course, it will reopen again when the KW usage drops below this level, again with a slight hysteresis.

Figure 6:
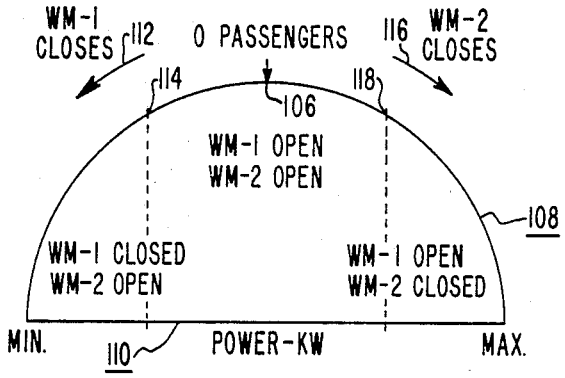
FIG. 6 is a graph which illustrates a contact sequence of a contact making watt meter for developing load and travel direction related signals from escalator control.

FIG. 6 is a graphical representation of the operation of contacts WM-1 and WM-2. Point 106 on half-circle 108 indicates power usage for no passenger load, for either travel direction. Power usage is indicated by projecting points on circle 108 vertically downward to horizontal line 110. With no load on the escalator, in either travel direction, both contacts WM-1 and WM-2 are open. Increased passenger loading while the escalator is traveling in the downward direction is indicated by arrow 112. When the passenger load increases such that power consumption drops below point 114, contact WM-1 closes. Contact WM-2 is unaffected, and will still be in the open condition.

Increased passenger loading when the escalator is traveling in the upward direction, is indicated by arrow 116. When the passenger load increases such that power consumption increases beyond pointer 118, contact WM-2 closes. Contact WM-1 will be unaffected, and will still be in its open condition. Typical operating points for contacts WM-1 and WM-2 are also indicated on curve 105 in FIG. 5.

Figure 3:
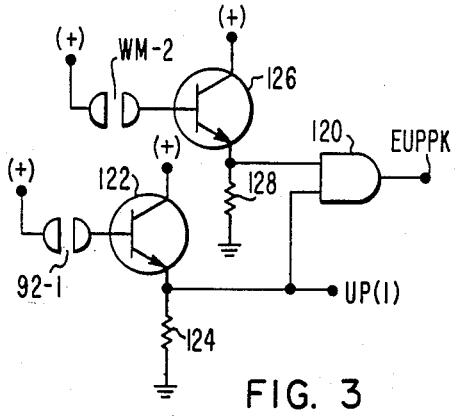
FIG. 3 is a schematic diagram of additional escalator control which may be used to develop a signal for triggering a predetermined strategy or mode in an associated elevator system.

FIG. 3 illustrates an exemplary arrangement which may be used to signal when escalator 14 is traveling upwardly with a load which exceeds point 118 of FIGS. 5 and 6, i.e., the load at which contact WM-2 closes. When escalator 14 is energized and traveling upwardly, up direction relay 92 will be energized, closing its n.o. contact 92-1. When contact 92-1 is closed, it enables one input of a dual input AND gate 120 via an npn transistor 122, a resistor 124, and suitable sources of unidirectional potential. When contact WM-2 of watt meter 106 closes, signifying that the load of the escalator exceeds the predetermined magnitude, AND gate 120 will have a logic one applied to its remaining input via an npn transistor 126, a resistor 128, and suitable sources of unidirectional potential. AND gate 120 will then output a true or high logic signal EUPPK, which will be used by the elevator system 10 to indicate approaching peak traffic, and by elevator system 12 to indicate departing peak traffic.

Figure 4:
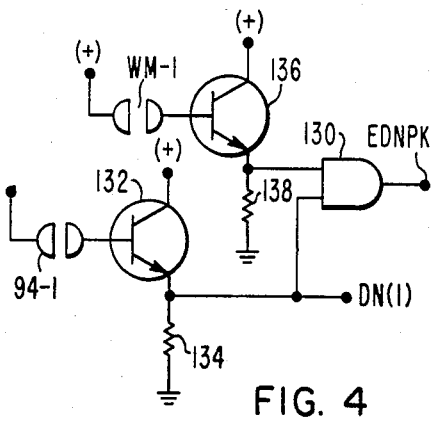
FIG. 4 is a schematic diagram of additional escalator control which may be used to develop a signal for triggering another strategy or mode in an associated elevator system.

In like manner, FIG. 4 illustrates an exemplary arrangement which may be used to signal when escalator 14 is traveling downwardly with a load large enough to drop power usage below point 114 of FIGS. 5 and 6, i.e., the load at which contact WM-1 closes. When escalator 14 is energized and traveling downwardly, down travel direction relay 94 will be deenergized, closing its n.o. contact 94-1. When contact 94-1 is closed, it enables one input of a dual input AND gate 130 via an npn transistor 132, a resistor 134, and suitable sources of unidirectional potential. When contact WM-1 of watt meter 106 closes, signifying its load has increased to a point which has dropped the power usage below the predetermined magnitude, AND gate 130 will have a logic one applied to its remaining input via an npn transistor 136, a resistor 138, and suitable sources of unidirectional potential. AND gate 130 will thus output a true or high logic signal EDNPK, which will be used by the elevator system 12 to indicate departing peak traffic, and by elevator system 14 to indicate approaching peak traffic.

Figure 7:
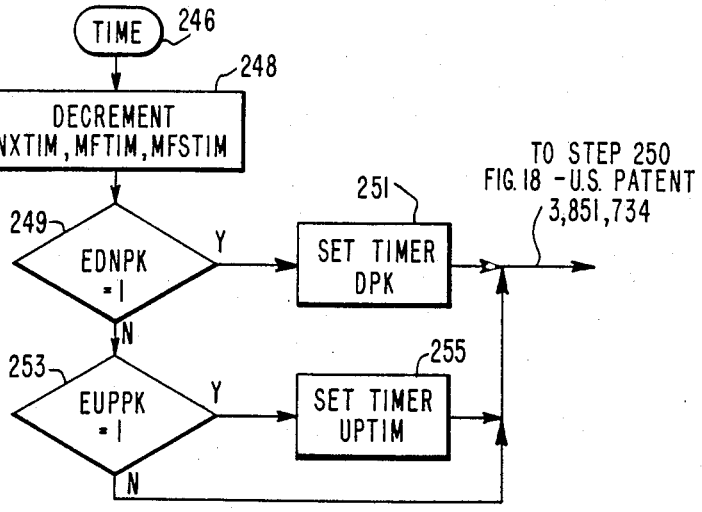
FIG. 7 is a flow chart of a subprogram TIME which may be used to control up peak and down peak timers.

Signals EUPPK and EDNPK are applied to parallel input ports 140 and 142 which are read by group supervisory controls 22 and 22', respectively. FIG. 7 illustrates how the flow chart of subprogram TIME shown in FIG. 18 of incorporated U.S. Pat. No. 3,851,734 may be modified to anticipate peak traffic in the elevator system in response to the loading and the direction of associated people mover apparatus. The program TIME is entered at terminal 246 and step 248 decrements certain software timers. Step 249 then reads input port 140 to check the logic level of signal EDNPK. If it is a logic one, indicating that traffic departing the elevator system 12 has reached a predetermined level, step 251 sets the software timer DPK to initiate the down peak strategy mode. Step 251 then proceeds to step 250 of the incorporated patent. Each time program TIME is run and step 249 finds that EDNPK is a logic one, timer DPK will be set to its maximum value. Thus, timer DPK will not time out until signal EDNPK is found to be a logic zero. Step 251 then proceeds to step 250 of the incorporated patent. If a system down peak is anticipated by step 249 finding EDNPK is a logic one, the system is not checked for up peaks, since down peaks have precedence.

If step 249 does not find signal EDNPK set, step 249 proceeds to step 253 which checks input port 140 to determine the logic level of signal EUPPK. If signal EUPPK is a logic one, indicating traffic approaching the elevator system 12 has reached a predetermined level, step 255 sets software timer UPTIM to initiate the up peak strategy mode. Step 251 then proceeds to step 250 of the incorporated patent, as does the "no" branch from step 253 when signal EUPPK is not a logic one. As hereinbefore described relative to signal EDNPK, as long as signal EUPPK is found to be a logic one in step 253, the software timer UPTIM will continually be set to its maximum value. It will time out to zero, returning the system to normal, after step 253 finds that signal EUPPK is no longer a logic one.

Figure 8:
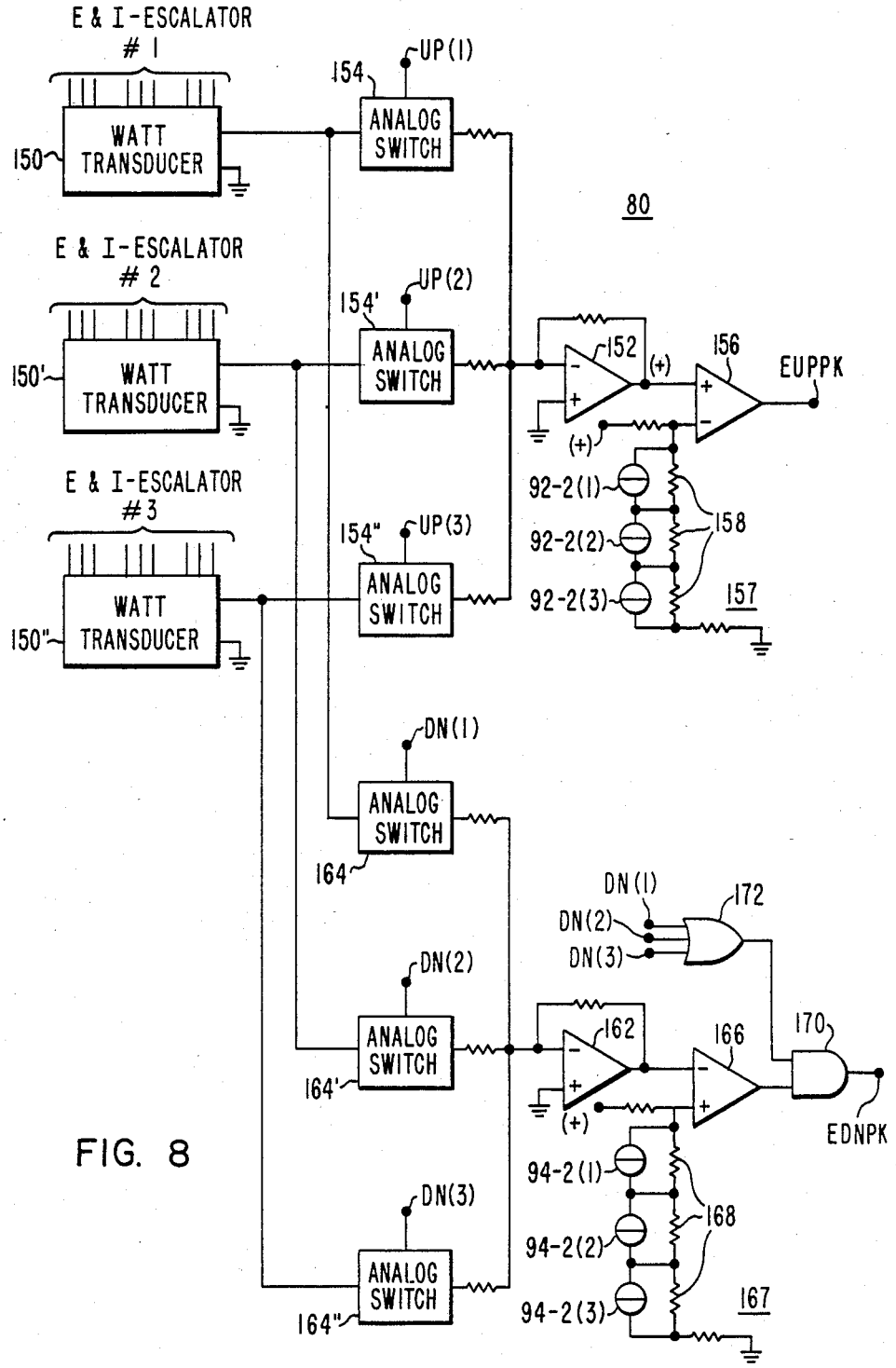
FIG. 8 is a schematic diagram of another embodiment of escalator control which may be used for the escalator control shown in block form in FIG. 1, for summing power usage when more than one escalator may serve a traffic direction.

FIG. 8 illustrates how the escalator control 80 shown in FIGS. 2, 3 and 4 may be modified when escalator 14 includes more than one drive unit, or when more than one escalator is arranged to serve the bank of elevator cars. In this embodiment, the contact making watt meter 106 is replaced by a watt transducer. For purposes of example, it will be assumed that three escalators are arranged to serve the elevator bank 12, with each having a single drive unit. Three watt transducers 150, 150' and 150" are each connected in a manner similar to that shown in FIG. 2 for the contact making watt meter 106, to measure the voltage E and current I being supplied to the associated electrical drive motor. Each watt transducer 150, 150' and 150" provides a D.C. signal proportional to the instantaneous electrical power usage of the associated electrical drive motor. The total electrical power usage by all escalators traveling upwardly is provided by operational amplifier (op amp) 152 which is connected as a summing amplifier, receiving at its inverting input the summed outputs of each watt transducer associated with an upwardly traveling escalator. Up traveling escalators are selected by analog switches 154, 154' and 154" having their control inputs connected to receive signal UP, which, as shown in FIG. 3, is a logic one when contact 92-1 of the associated up travel direction relay is energized. The output of op amp 152 is a positive value having a magnitude proportional to the total power consumed by up traveling escalators. The output of op amp 152 is connected to the non-inverting input of an op amp 156 connected as a comparator. The inverting input is connected to a reference 157 which includes a source of unidirectional potential, a plurality of resistors 158, and n.c. contacts 92-2(1), 92-2(2) and 92-2(3) of the up travel direction relays of the three escalators. These n.c. contacts of the up travel direction relays are arranged to parallel certain of the resistors. These contacts and the values of the resistors 158 are selected such that the reference 157 is automatically adjusted to the correct value for the number of up traveling escalators. The output of op amp 152 will normally be less than the reference voltage provided by reference 157, and thus the output of op amp 156 will be a logic zero. If the combined power usage increases to the reference level, op amp 156 will switch to provide a logic one at its output, which is a true signal EUPPK. Signal EUPPK is applied to the input ports 140 and 142, as hereinbefore described.

In like manner, the total electrical power usage by all escalators traveling downwardly is provided by op amp 162 which is connected as a summing amplifier, receiving at its inverting input the summed outputs of each watt transducer associated with a downwardly traveling escalator. Down traveling escalators are selected by analog switches 164, 164' and 164", with their control inputs being connected to receive signal DN. As shown in FIG. 4, signal DN is a logic one when contact 94-1 of the associated down traveling direction relay is energized. The output of op amp 162 is a positive value having a magnitude proportional to the total power consumed by down traveling escalators. The output of op amp 162 is connected to the inverting input of an op amp 166 connected as a comparator. The non-inverting input of op amp 166 is connected to a reference 167 which includes a source of unidirectional potential, a plurality of resistors 168, and n.c. contacts 94-2(1), 94-2(2) and 94-2(3) of the down travel direction relays associated with the three escalators. Reference 167 is automatically adjusted to the correct value for the number of down traveling escalators by the arrangement of the contacts from the down direction relays and resistors.

The output of op amp 162 will normally be greater than the reference level, and thus op amp 166 will output a logic zero. Should the combined power usage of down traveling escalators fall below the reference level, indicating a down traffic peak on the escalators, the output of op amp 166 will switch to a logic one. Since the input to op amp 166 will be less than the reference level when no escalators are traveling down, a dual input AND gate 170 and a three input OR gate 172 are provided. The output of op amp 166 is connected to one input of AND gate 170, and the output of OR gate 172 is connected to its other input. Signals DN from the three escalators are connected to the inputs of OR gate 172. If any escalator is operating and traveling in a downward direction, OR gate 172 will output a logic one, enabling AND gate 170 to respond to the logic level of op amp 166. If no escalators are traveling in a downward direction, AND gate 170 will be disabled, causing it to output a logic zero signal. If AND gate 170 is enabled by OR gate 172, and the output of op amp 166 switches high to signify the power usage by the down traveling escalators has dropped below the reference magnitude, AND gate 170 will output a true or logic one signal EDNPK. Signal EDNPK will be utilized by the associated elevator system 12 as hereinbefore described relative to FIG. 7.

In summary, there has been disclosed a new and improved transportation system which includes an elevator system served by people mover apparatus. The disclosed system anticipates traffic peaks in the elevator system before they actually occur, in response to predetermined signals from the people mover apparatus. Thus, the elevator system, being made aware of traffic peaks before they occur, may more efficiently serve its passengers by already being in the correct operating mode to serve the traffic peak when it occurs.

We claim as our invention:

1. A system for cooperation between an elevator system and an escalator, comprising:

a building having a plurality of floors, an elevator system in said building having a plurality of elevator cars for serving said floors, group supervisory control for said elevator system having selectable operating strategies, including first and second travel direction strategies for expediting peak travel in first and second travel directions, respectively, an escalator in said building arranged to serve a predetermined floor thereof, and load means responsive to the travel direction of said escalator and to a predetermined passenger load on said escalator, for providing a first signal when the predetermined load is exceeded in the travel direction of the escalator which delivers passengers to the predetermined floor of the building, and a second signal when the predetermined load is exceeded in the travel direction of the escalator which takes passengers away from the predetermined floor of the building, wherein the group supervisory control selects the first travel direction strategy in response to one of the signals being provided by said load means, and the second travel direction strategy in response to the other of the signals being provided by said load means.

* * * * *